US010319261B2

(12) United States Patent
Lyon

(10) Patent No.: US 10,319,261 B2
(45) Date of Patent: Jun. 11, 2019

(54) SELF-ERECTABLE DISPLAYS AND METHODS OF MAKING SUCH SELF-ERECTABLE DISPLAYS

(71) Applicant: R.R. Donnelley & Sons Company, Chicago, IL (US)

(72) Inventor: Jon Lyon, Joliet, IL (US)

(73) Assignee: R.R. Donnelley & Sons Company, Chicago, IL (US)

( * ) Notice: Subject to any disclaimer, the term of this patent is extended or adjusted under 35 U.S.C. 154(b) by 0 days.

(21) Appl. No.: 15/786,405

(22) Filed: Oct. 17, 2017

(65) Prior Publication Data

US 2018/0040262 A1 Feb. 8, 2018

Related U.S. Application Data

(63) Continuation of application No. 14/709,285, filed on May 11, 2015, now Pat. No. 9,812,038.

(51) Int. Cl.
*G09F 15/00* (2006.01)
*G09F 1/06* (2006.01)

(52) U.S. Cl.
CPC ..... *G09F 1/065* (2013.01)

(58) Field of Classification Search
CPC ..... G09F 15/0031; G09F 15/0056
USPC ..... 40/124.14, 124.19
See application file for complete search history.

(56) References Cited

U.S. PATENT DOCUMENTS 822,841 A 6/1906 Hill
956,916 A 5/1910 Wiederseim, Jr.
1,028,147 A 6/1912 Stranders
1,545,771 A 7/1925 Hout
1,576,672 A 3/1926 Miller
1,656,341 A 1/1928 Smith
1,670,464 A 5/1928 Marsh
(Continued)

FOREIGN PATENT DOCUMENTS

CN 203192354 9/2013
DE 2658506 1/1978
(Continued)

OTHER PUBLICATIONS

United States Patent and Trademark Office, "Notice of Allowance," issued in connection with U.S. Appl. No. 14/988,616, dated Feb. 28, 2018, 8 pages.

(Continued)

*Primary Examiner* — Joanne Silbermann
(74) *Attorney, Agent, or Firm* — Hanley, Flight & Zimmerman, LLC

(57) ABSTRACT

Self-erectable displays and methods of making such self-erectable displays are disclosed. An example apparatus, includes a shroud defining an aperture, the shroud including a first shroud panel and a second shroud panel; a support disposed within the aperture, the support including a first panel, a second panel, a third panel, a fourth panel, a fifth panel, and a sixth panel, the first panel coupled to the sixth panel, the second panel disposed between the first and third panels, the fourth panel disposed between the third and fifth panels, the sixth panel disposed between the first and fifth panels, the first panel coupled to the first shroud panel and the fourth panel coupled to the second shroud panel; and an elastic band to urge the first panel away from the fourth panel and to urge the shroud toward an expanded position.

18 Claims, 9 Drawing Sheets

(56) References Cited

U.S. PATENT DOCUMENTS

| | | | |
|---|---|---|---|
| 1,687,616 | A | 10/1928 | Huye |
| 1,902,566 | A | 3/1933 | Marsh |
| 2,108,349 | A | 2/1938 | Rasmussen |
| 2,113,288 | A | 4/1938 | Berger |
| 2,142,826 | A | 1/1939 | Rosello |
| 2,153,460 | A | 4/1939 | Giles |
| 2,210,317 | A | 8/1940 | Dueringer |
| 2,283,406 | A | 5/1942 | Bacon |
| 2,290,144 | A | 7/1942 | Katz |
| 2,404,089 | A | 7/1946 | Pollock |
| 2,601,374 | A | 6/1952 | Ditzler et al. |
| 2,637,924 | A | 5/1953 | Hutt |
| 2,728,461 | A | 12/1955 | Paige |
| 2,773,324 | A | 12/1956 | Drueck, Jr. |
| 2,833,074 | A | 5/1958 | Jannes |
| 2,892,276 | A | 6/1959 | Nelson |
| 2,918,178 | A | 12/1959 | Leone |
| 2,984,920 | A | 5/1961 | Acosta et al. |
| 3,015,898 | A | 1/1962 | Keeslar |
| 3,091,877 | A | 6/1963 | Luchsinger |
| 3,234,682 | A | 2/1966 | Frankl |
| 3,267,597 | A | 8/1966 | Jannes |
| 3,302,321 | A | 2/1967 | Walker |
| 3,571,958 | A | 3/1971 | Stevens et al. |
| 3,665,669 | A | 5/1972 | Huber |
| 3,666,607 | A | 5/1972 | Weissman |
| 4,234,148 | A | 11/1980 | Maddestra et al. |
| 4,610,363 | A | 9/1986 | Flum et al. |
| 4,619,426 | A | 10/1986 | Drueck, Jr. |
| 4,750,283 | A | 6/1988 | Halpern |
| 4,770,379 | A | 9/1988 | Estvold |
| 4,773,622 | A | 9/1988 | Herlin |
| 4,774,780 | A | 10/1988 | Crowell |
| 4,790,714 | A | 12/1988 | Schnapp |
| 4,854,060 | A | 8/1989 | Corbo et al. |
| 4,940,199 | A | 7/1990 | Hall |
| 4,984,848 | A | 1/1991 | Scalisi et al. |
| 4,993,846 | A | 2/1991 | Diamond et al. |
| 5,000,717 | A | 3/1991 | Pfeiffer |
| 5,193,466 | A | 3/1993 | Eder |
| 5,197,631 | A | 3/1993 | Mishima |
| 5,297,677 | A | 3/1994 | Burian et al. |
| 5,416,997 | A | 5/1995 | Dyment et al. |
| 5,454,180 | A | 10/1995 | Volpe |
| 5,467,547 | A | 11/1995 | Fortner |
| 5,632,390 | A | 5/1997 | Podergois |
| 5,752,649 | A | 5/1998 | Weder |
| 5,758,438 | A | 6/1998 | Crowell |
| 5,778,959 | A | 7/1998 | Guetschow |
| 5,787,621 | A | 8/1998 | Leksell |
| 5,809,673 | A | 9/1998 | Johnson et al. |
| 5,868,367 | A | 2/1999 | Smith |
| 5,878,945 | A | 3/1999 | Weder |
| 5,937,553 | A | 8/1999 | Maran |
| 5,966,857 | A | 10/1999 | Pettersson et al. |
| 5,983,538 | A | 11/1999 | Crowell |
| 6,311,418 | B1 | 11/2001 | Crowell |
| 6,347,772 | B1 | 2/2002 | L'Hotel |
| 6,497,601 | B1 | 12/2002 | Ward |
| 7,134,230 | B1 | 11/2006 | Boens et al. |
| 7,159,350 | B2 | 1/2007 | L'Hotel |
| 7,234,253 | B2 | 6/2007 | Ossmann |
| 7,437,842 | B2 | 10/2008 | Sgambellone |
| 7,634,865 | B2 | 12/2009 | L'Hotel |
| 7,726,054 | B2 | 6/2010 | Mestres Armengol et al. |
| 7,774,964 | B2 | 8/2010 | L'Hotel |
| 7,980,013 | B2 | 7/2011 | Hsu |
| 8,099,883 | B2 | 1/2012 | Mestres Armengol et al. |
| 8,112,925 | B2 | 2/2012 | Tzuo |
| 8,291,631 | B2 | 10/2012 | Wilder |
| 8,458,939 | B2 | 6/2013 | Arthur et al. |
| 8,590,188 | B2 | 11/2013 | Mirsch |
| 8,701,321 | B2 | 4/2014 | Da Fonseca et al. |
| 8,776,415 | B2 | 7/2014 | Kawaguchi et al. |
| 8,826,833 | B1 | 9/2014 | Fischer et al. |
| 8,863,418 | B2 | 10/2014 | Acker et al. |
| 8,875,908 | B2 | 11/2014 | L'Hotel |
| 9,173,485 | B2 | 11/2015 | Fischer et al. |
| 9,715,840 | B1 | 7/2017 | Warmus |
| 10,008,138 | B2 | 6/2018 | Bonifas |
| 2004/0111930 | A1 | 6/2004 | Ossmann |
| 2008/0066353 | A1 | 3/2008 | Mills |
| 2008/0083146 | A1 | 4/2008 | Martin Presa |
| 2010/0072330 | A1 | 3/2010 | Tzuo |
| 2010/0236117 | A1 | 9/2010 | Mestres Armengol et al. |
| 2011/0088300 | A1 | 4/2011 | Martin Presa |
| 2012/0012734 | A1 | 1/2012 | Tzuo |
| 2012/0227297 | A1 | 9/2012 | Kawaguchi et al. |
| 2013/0219760 | A1 | 8/2013 | Acker et al. |
| 2014/0265777 | A1 | 9/2014 | Fischer et al. |
| 2016/0335925 | A1 | 11/2016 | Ruhaak |
| 2016/0335934 | A1 | 11/2016 | Lyon |
| 2016/0335935 | A1 | 11/2016 | Lyon |
| 2017/0193866 | A1 | 7/2017 | Bonifas |
| 2017/0213485 | A1 | 7/2017 | Santoro, Jr. |
| 2017/0294149 | A1 | 10/2017 | Lyon |
| 2018/0075781 | A1 | 3/2018 | Cwidak et al. |
| 2018/0075788 | A1 | 3/2018 | Warmus et al. |
| 2018/0211571 | A1 | 7/2018 | Enriquez |

FOREIGN PATENT DOCUMENTS

| | | |
|---|---|---|
| DE | 4005925 | 10/1991 |
| DE | 4314654 | 11/1994 |
| DE | 9320993 | 8/1995 |
| DE | 202010015312 | 1/2011 |
| DE | 202011002980 | 4/2011 |
| DE | 202014106297 | 3/2015 |
| DK | 9500055 | 5/1995 |
| DK | 9500277 | 9/1995 |
| EP | 1741368 | 1/2007 |
| EP | 1830334 | 9/2007 |
| EP | 1926076 | 5/2008 |
| EP | 2290637 | 3/2011 |
| EP | 2400477 | 12/2011 |
| ES | 2212927 | 8/2004 |
| ES | 2255857 | 7/2006 |
| FR | 1254983 | 3/1961 |
| FR | 2210317 | 7/1974 |
| FR | 2232259 | 12/1974 |
| FR | 2233912 | 1/1975 |
| FR | 2571949 | 4/1986 |
| FR | 2574968 | 6/1986 |
| FR | 2650907 | 2/1991 |
| FR | 2680030 | 2/1993 |
| FR | 2691621 | 12/1993 |
| FR | 2730148 | 8/1996 |
| FR | 2735264 | 12/1996 |
| FR | 2745109 | 8/1997 |
| FR | 2760801 | 9/1998 |
| FR | 2760802 | 9/1998 |
| FR | 2760880 | 9/1998 |
| FR | 2770320 | 4/1999 |
| FR | 2911425 | 7/2008 |
| FR | 2925203 | 6/2009 |
| FR | 2925204 | 6/2009 |
| FR | 2948222 | 1/2011 |
| GB | 463574 | 4/1937 |
| GB | 740577 | 11/1955 |
| GB | 743378 | 1/1956 |
| GB | 824004 | 11/1959 |
| GB | 1034280 | 6/1966 |
| GB | 1272187 | 4/1972 |
| GB | 1317155 | 5/1973 |
| WO | 9634379 | 10/1996 |
| WO | 9936900 | 7/1999 |
| WO | 2002095719 | 11/2002 |
| WO | 2004044867 | 5/2004 |
| WO | 2006040438 | 4/2006 |
| WO | 2006067252 | 6/2006 |
| WO | 2007138083 | 12/2007 |
| WO | 2008049176 | 5/2008 |
| WO | 2010019086 | 2/2010 |
| WO | 2010130485 | 11/2010 |

(56) References Cited

FOREIGN PATENT DOCUMENTS

| | | |
|---|---|---|
| WO | 2011092209 | 8/2011 |
| WO | 2011113123 | 9/2011 |
| WO | 2012061375 | 5/2012 |
| WO | 2016057067 | 4/2016 |
| WO | 2017116605 | 7/2017 |

OTHER PUBLICATIONS

United States Patent and Trademark Office, "Notice of Allowance," issued in connection with U.S. Appl. No. 15/415,587, dated Jan. 19, 2018, 7 pages.
United States Patent and Trademark Office, "Non-Final Office action," issued in connection with U.S. Appl. No. 15/634,974, dated Apr. 9, 2018, 11 pages.
United States Patent and Trademark Office, "Non-Final Office Action," issued in connection with U.S. Appl. No. 14/709,266, dated May 23, 2016, 32 pages.
United States Patent and Trademark Office, "Notice of Allowance," issued in connection with U.S. Appl. No. 14/709,266, dated Sep. 26, 2016, 31 pages.
United States Patent and Trademark Office, "Non-Final Office Action," issued in connection with U.S. Appl. No. 14/709,285, dated Sep. 15, 2016, 38 pages.
United States Patent and Trademark Office, "Non-Final Office Action," issued in connection with U.S. Appl. No. 14/711,739, dated Sep. 16, 2016, 37 pages.
United States Patent and Trademark Office, "Non-Final Office Action," issued in connection with U.S. Appl. No. 15/229,920, dated Dec. 1, 2016, 9 pages.
International Searching Authority, "International Search Report and Written Opinion", issued in connection with PCT Application No. PCT/US2016/064478, dated Jan. 24, 2017, 15 pages.
United States Patent and Trademark Office, "Office Action," issued in connection with U.S. Appl. No. 14/709,285, dated Mar. 15, 2017, 24 pages.
United States Patent and Trademark Office, "Notice of Allowance," issued in connection with U.S. Appl. No. 15/229,920, dated Mar. 22, 2017, 43 pages.
United States Patent and Trademark Office, "Final Office Action," issued in connection with U.S. Appl. No. 14/711,739, dated Mar. 21, 2017, 19 pages.
United States Patent and Trademark Office, "Non-final Office Action," issued in connection with U.S. Appl. No. 14/988,616, dated Apr. 11, 2017, 36 pages.
United States Patent and Trademark Office, "Notice of Allowance," issued in connection with U.S. Appl. No. 14/709,266, dated Apr. 12, 2017, 17 pages.
United States Patent and Trademark Office, "Notice of Allowance," issued in connection with U.S. Appl. No. 14/709,285, dated Jul. 3, 2017, 19 pages.
United States Patent and Trademark Office, "Office Action," issued in connection with U.S. Appl. No. 15/415,587, dated Aug. 4, 2017, 40 pages.
United States Patent and Trademark Office, "Office Action," issued in connection with U.S. Appl. No. 15/261,178, dated Sep. 29, 2017, 46 pages.
International Searching Authority, "International Search Report," issued in connection with PCT Patent Application No. PCT/US2017/045471, dated Oct. 18, 2017, 5 pages.
International Searching Authority, "Written Opinion," issued in connection with PCT Patent Application No. PCT/US2017/045471, dated Oct. 18, 2017, 6 pages.
United States Patent and Trademark Office, "Notice of Allowance," issued in connection with U.S. Appl. No. 15/261,178, dated Aug. 3, 2018, 5 pages.
United States Patent and Trademark Office, "Restriction Requirement", issued in connection with U.S. Appl. No. 15/261,191, dated Aug. 31, 2018, 6 pages.

SELF-ERECTABLE DISPLAYS AND METHODS OF MAKING SUCH SELF-ERECTABLE DISPLAYS

RELATED APPLICATION

This patent arises from a continuation of U.S. patent application Ser. No. 14/709,285, filed May 11, 2015. U.S. patent application Ser. No. 14/709,285 is hereby incorporated herein by reference in its entirety. Priority is claimed to U.S. patent application Ser. No. 14/709,285.

FIELD OF THE DISCLOSURE

This disclosure relates generally to displays and, more particularly, to self-erectable displays and methods of making such self-erectable displays.

BACKGROUND

Displays may be used at a point of purchase to provide advertising or other information. Some of these displays have a tubular shape and include outwardly facing indicia.

BRIEF DESCRIPTION OF THE DRAWINGS

The figures are not to scale. Wherever possible, the same reference numbers will be used throughout the drawing(s) and accompanying written description to refer to the same or like parts.

DETAILED DESCRIPTION

Figure 1:
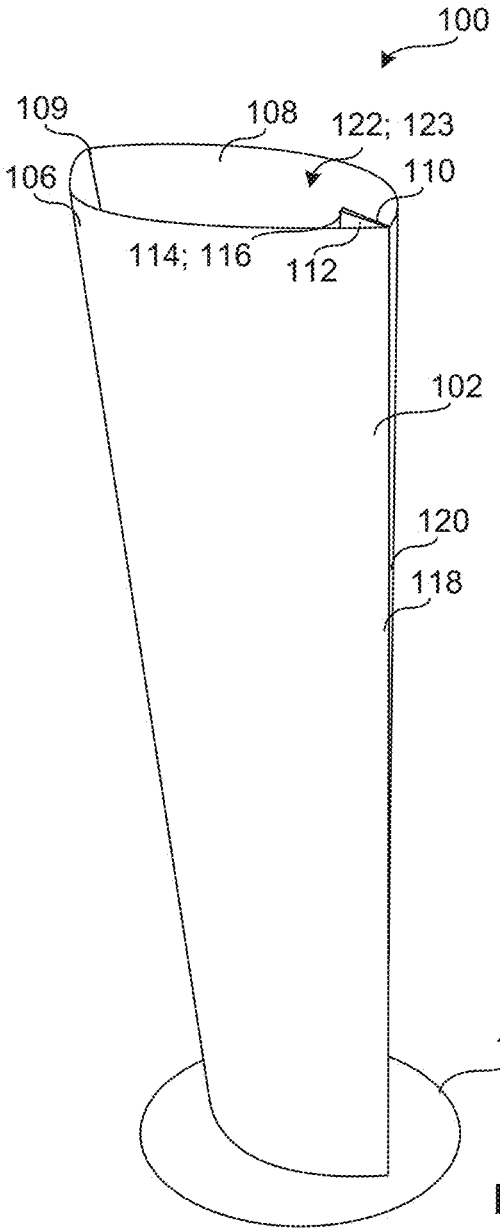
FIG. 1 is a perspective view of an example self-erectable display in accordance with the teachings of this disclosure.

The examples disclosed herein relate to self-erectable displays that can be used for point-of-sale advertising, providing information, or for other suitable purposes. In some examples, the example self-erectable displays may be shipped to a customer in a folded, flat state. The example displays may include a biased support that is in a state of tension when the display is in the folded, flat state because forces imparted by the folded material of the display is greater than a force exerted by the biased support. However, when the display is unfolded, the force being imparted on the biased support is less than the force exerted by the biased support, thereby enabling the biased support to urge the display from the folded position to the erected position. Thus, using the examples disclosed herein, an individual can erect the example displays with little if any instruction and/or training.

In some examples disclosed herein, the example self-erectable displays include an elongate, tubular shroud into which an internal structure is disposed. In some examples, the shroud includes an oblong cross-section having an example base coupled at an end and the internal structure includes an example biased support(s) coupled within the shroud. In some examples, the cross-section may be another shape including, for example, triangular, square, diamond, circular, or other semi-circular, elliptical, polygonal and/or non-polygonal shape(s).

In some examples, the example shroud is formed of an elongate substrate having top and bottom edges and first and second side edges. To enable the example self-erectable display to be folded for shipping and/or storage, in some examples, longitudinal lines of weakness and transverse lines of weakness are defined in the shroud. The longitudinal lines of weakness may enable the example self-erectable display to be folded relatively flat and the transverse lines of weakness may enable the example self-erectable display to be folded about itself to form a z-fold, for example.

In some examples, the longitudinal and transverse lines of weakness define central panels and outwardly facing flaps. To form the tubular-shaped shroud, the shroud is folded about a central line of weakness and the flaps are inwardly folded and coupled to enable the shroud to have an oblong cross-section and/or to define an aperture. In some examples, to enable the shroud to be more easily folded about itself, notches are defined between the flaps. The example shrouds disclosed herein may include any number of display panels (e.g., one, two, three, four, etc.) and/or any number of example supports (e.g., one example support per panel or more than one support per panel) disposed within the example shrouds depending on the application, etc. Also, in some examples, a support may be used for multiple panels.

In some examples, the example support is formed of a substrate having top and bottom edges and first and second side edges. To enable the example support to be formed and/or to enable the support to be folded relatively flat within the example shroud for shipping and/or storage, in some examples, lines of weakness are formed in the support to define four relatively larger panels and three relatively smaller panels. In some examples, pairs of the larger panels are disposed adjacent one another and one of the smaller panels is disposed on either side of each pair of the larger panels. To enable an elastic band to be more easily coupled to the support, in some examples, notches are formed between the larger panels that receive the elastic band.

To form the tubular-shaped support, in some examples, the support is folded about the lines of weakness and the ends of the support are brought together and coupled. In some examples, to couple the ends of the support together, a tongue adjacent a side edge of the support is received in an aperture defined adjacent another side edge of the support. However, the side edges of the support may be coupled in any suitable manner.

After the side edges of the support are coupled, to urge the larger support panels toward one another and outwardly bias the smaller support panels, in some examples, an elastic band is disposed about the support such that at least a first portion of the elastic band is disposed relatively parallel to the lines of weakness of the support and at least a second portion of the elastic band extends across an aperture defined by the tubular-shaped support. In some examples, the dimensions of the supports and the elasticity of the bands are selected to solely or fully brace the display in the erected or deployed position. In other words, the dimensions of the panels of the example support(s) and/or the elasticity and/or dimensions of the elastic band(s) used in connection with the example support(s) are tuned in combination and/or configured in such a way that some structure included on some other example supports may be excluded. For example, unlike some example supports, the example biased supports disclosed herein may exclude a "stop" panel that controls the movement of different structures of those example supports relative to one another when an elastic band is coupled thereto. By excluding some of these additional structures in connection with the example supports disclosed herein, less material may be used to produce the example supports, thereby saving money in material and/or time producing and/or manufacturing the example supports disclosed herein.

To form the self-erectable display, the example tubular support is coupled within the example tubular shroud. In some examples, the smaller support panels are directly coupled to the shroud panels such that the lines of weakness of the support that separate the larger support panels face the flaps or the central lines of weakness of the shroud. When the support is coupled within the tubular-shaped shroud, the shroud panels are outwardly biased by the smaller support panels via the elastic band. However, if the smaller support panels are moved toward one another against the biasing force of the elastic band, the lines of weakness that separate the larger support panels are moved toward the ends of the shroud to enable the shroud panels to move toward one another and be disposed immediately adjacent one another. When the shroud panels are disposed adjacent one another, the shroud may be folded about itself along the transverse lines of weakness to enable the display to be stored and/or shipped. Thus, the examples disclosed herein enable a display to be folded flat for storage and to later self-erect into a tubular shape.

FIG. 1 illustrates an example self-erectable display 100 including a tubular-shaped shroud 102 coupled to a base 104. In other examples, the example self-erectable display 100 may not include the base 104 such that the shroud 102 is used as an upright display without the base 104.

In this example, the shroud 102 includes opposing first and second shroud panels 106, 108 that are separated by a central line of weakness 109 and flaps 110, 112 adjacent side edges 114, 116 of the shroud 102. In this example, the flaps 110, 112 are coupled together to enclose the shroud 102 and to enable adjacent longitudinal lines of weakness 118, 120 to define an outward facing end of the tubular-shaped shroud 102 opposite the central line of weakness 109 that defines another outward facing end of the shroud 102. To enable the display 100 to be self-erecting, example first and second biased supports 122, 123 are disposed within the example shroud 102.

Figure 2:
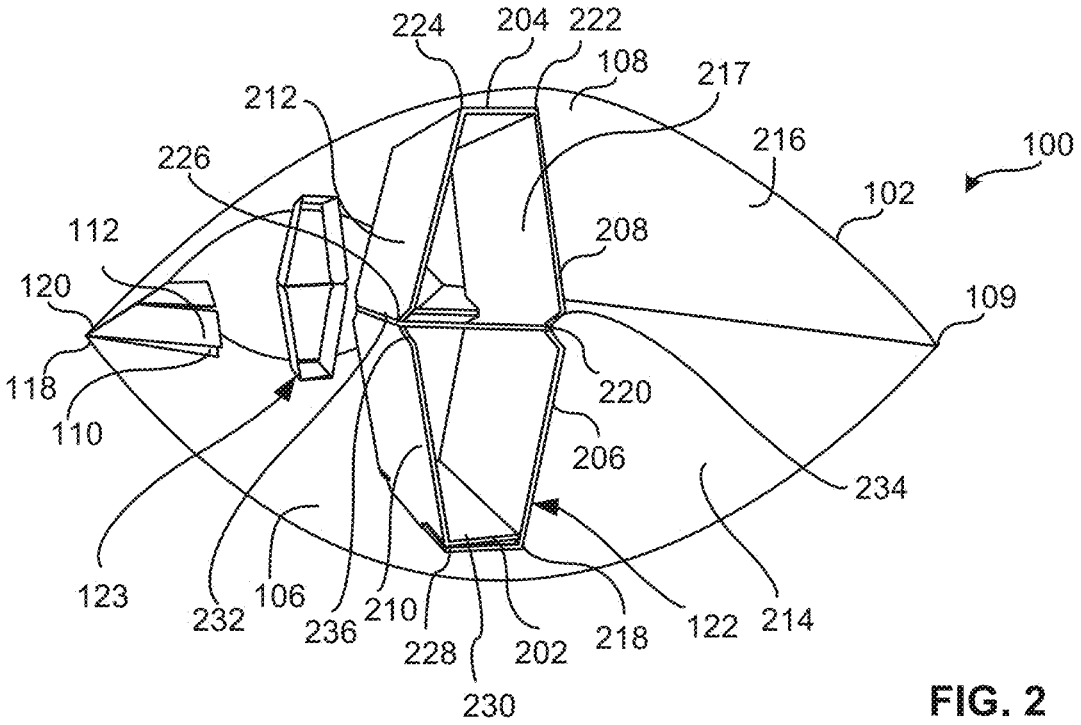
FIG. 2 is a top view of the self-erectable display of FIG. 1.

FIG. 2 shows a top view of the example self-erectable display 100 that illustrates the biased supports 122, 123 coupled within the shroud 102. In this example, the supports 122, 123 are the same or substantially the same size and/or shape. Referring to the first biased support 122, in this example, the first biased support 122 includes first and second support panels 202, 204 and third, fourth, fifth and sixth support panels 206, 208, 210, 212. As shown in the example of FIG. 2, the first support panel 202 is coupled to an internal surface 214 of the first shroud panel 106 and the second support panel 204 is coupled to an internal surface 216 of the second shroud panel 108. In this example, the support 122 is formed using a substrate 217 including first, second, third, fourth, fifth and sixth lines of weakness 218, 220, 222, 224, 226, 228 that define the first, second, third, fourth, fifth, sixth and seventh support panels 202, 204, 206, 208, 210, 212, 230. To enable an elastic band 232 to be disposed about the support 122, notches 234 are defined between the third and fourth panels 206, 208 and notches 236 are defined between the fifth and sixth panels 210, 212.

When the substrate 217 is folded about the lines of weakness 218, 220, 222, 224, 226, 228, the first support panel 202 is coupled to the seventh support panel 230. The first and seventh support panels 202, 230 may be coupled in any suitable way such as with adhesive, glue, staple(s) and/or a tongue on one of the support panels 202, 230 extending through an aperture on the other of the support panels 202, 230. Other suitable mechanical and/or chemical fastener(s) may additionally or alternatively be used. After the support panels 202, 230 are coupled, the elastic band 232 is positioned about the support 122 and held in place, in this example, by being disposed within the notches 234, 236. The interaction between the elastic band 232 and the substrate 217 urges the lines of weakness 220, 226 toward one another and urges the support panels 202, 204 away from one another. After the support 122 is formed into a tubular shape and the elastic band 232 is disposed about the substrate 217, the first support panel 202 is coupled to the first shroud panel 106 and the second support panel 204 is coupled to the second shroud panel 108. The support panels 202, 204 may be coupled to the shroud panels 106, 108 in any suitable way such as with adhesive, glue, tape, staples, and/or any other suitable mechanical and/or chemical fastener(s). As shown in example of FIG. 2, the biasing force imposed by the elastic band 232 outwardly urges the support panels 202, 204 and, in turn, outwardly urges the shroud panels 106, 108 to have an oblong cross-section when erected. To flatten the example self-erectable display 100, the support panels 202, 204 and the shroud panels 106, 108 are urged toward one another against the biasing force of the elastic band 232. For example, a user may push the opposite sides of the shroud panels 106, 108 together to flatten the display 100.

Figure 3:
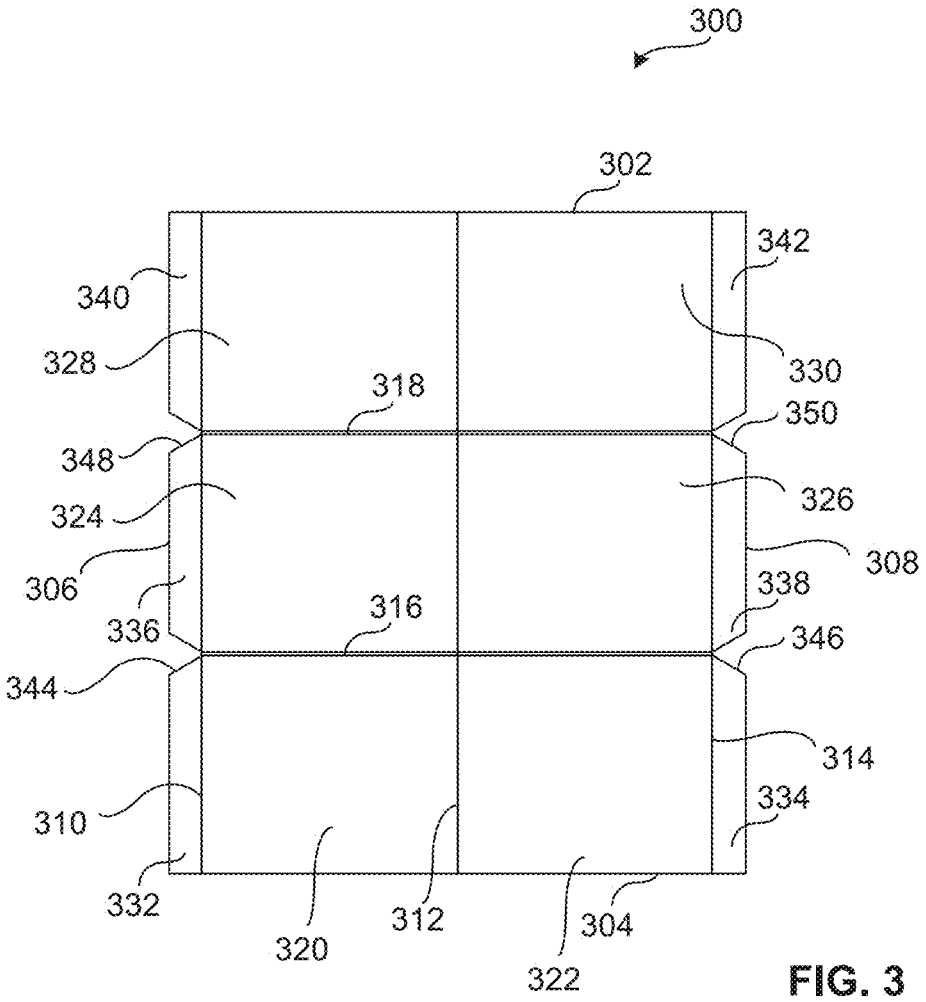
FIG. 3 illustrates a plan view of an example shroud in a flat state that can be used to implement the example self-erectable display of FIG. 1

FIG. 3 illustrates an example shroud 300 in a flat state that can be used to implement the example self-erectable display 100 of FIG. 1. While the example shroud 300 is shown as being a single piece of substrate, in other examples, the shroud may be more than one piece of substrate that is coupled together to form the example self-erectable display as disclosed herein. In this example, the shroud 300 includes top and bottom edges 302, 304 and first and second side edges 306, 308. To enable the shroud 300 to be foldable for shipping and/or storage, the shroud 300 defines first, second and third longitudinal lines of weakness 310, 312, 314 and first and second transverse lines of weakness 316, 318. In this example, the longitudinal lines of weakness 310, 312, 314 are substantially perpendicular relative to the transverse lines of weakness 316, 318. As used herein, substantially perpendicular means between about 5-degrees from perpendicular and/or accounts for manufacturing tolerances.

In this examples, the lines of weakness 310, 312, 314, 316, 318 define first, second, third, fourth, fifth and sixth central panels 320, 322, 324, 326, 328, 330 and first, second, third, fourth, fifth and sixth flaps 332, 334, 336, 338, 340, 342. As shown in the example of FIG. 3, notches 344, 346, 348, 350 are defined by the shroud 300 between the flaps 332, 334, 336, 338, 340, 342.

To form the tubular-shaped shroud 300, the shroud 300 is folded about the second line of weakness 312 and the flaps 332, 334, 336, 338, 340, 342 are inwardly folded about the first and third lines of weakness 310, 314 to enable the opposing flaps 332 and 334, 336 and 338, 340 and 342 to be coupled to one another and disposed within an interior of the shroud 300. The opposing flaps 332 and 334, 336 and 338, 340 and 342 may be coupled in any suitable way using, for example, adhesive, glue, tape, staples, and/or any suitable mechanical and/or chemical fastener(s). After the flaps 332 and 334, 336 and 338, 340 and 342 are coupled, the shroud 300 may be folded (e.g., a z-fold or a c-fold) about the transverse axes 316, 318 for shipping and/or storage. In some examples, the notches 344, 346, 348, 350 may more easily enable the shroud 300 to be folded about the transverse axes 316, 318.

Figure 4:
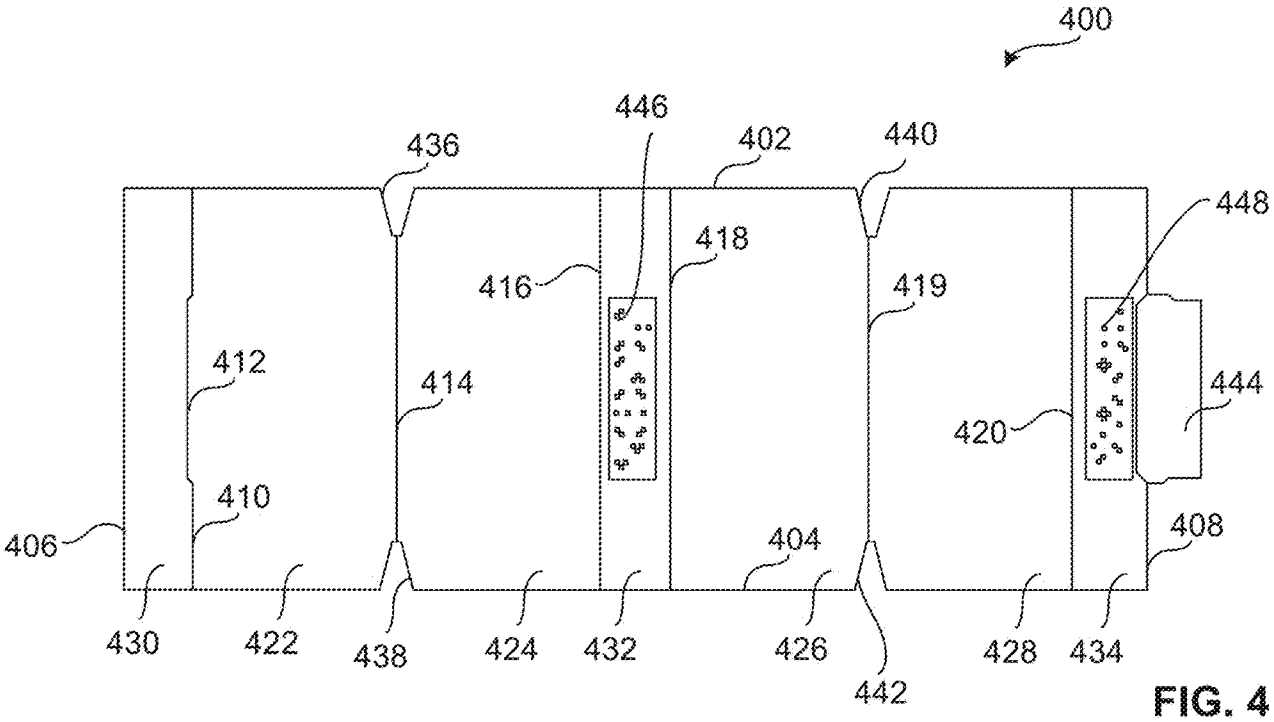
FIG. 4 illustrates a plan view of an example support in a flat state that can be used to implement the example self-erectable display of FIG. 1.

FIG. 4 illustrates an example support and/or insert 400 in a flat state that can be used to implement the example self-erectable display 100 of FIG. 1. In this example, the support 400 includes top and bottom edges 402, 404 and first and second side edges 406, 408. To enable the example support 400 to be formed and/or to enable the support 400 to be folded flat within the example shroud 300 for shipping and/or storage, in some examples, lines of weakness 410, 412, 414, 416, 418, 419, 420 are formed in the support 400 to define first, second, third and fourth larger panels 422, 424, 426, 428 and first, second and third smaller panels 430, 432, 434. The lines of weakness 410, 412, 414, 416, 418, 419, 420 may be similar or different. For example, while other examples exist, the line of weakness 410 may be a crease while the line of weakness 412 may be a die cut. In some examples, the first and second larger panels 422, 424 are positioned between the first and second smaller panels 430, 432 and the third and fourth larger panels 426, 428 are positioned between the second and third smaller panels 432, 434. To enable an elastic band to be coupled to and more easily retained about the support 400, in this example, notches 436, 438 are formed between the first and second larger panels 422, 424 and notches 440, 442 are formed between the third and fourth larger panels 426, 428. In this example, the notches 436, 438 are v-shaped and oppose one another and the notches 440, 442 are v-shaped and oppose one another. In other examples, one or more of the notches 436, 438, 440, 442 may be differently shaped and/or the support 400 may define more or less notches than shown in this example. Also, in some examples, apertures through which the elastic member is threaded may be used in addition to or alternatively to the notches 436, 438, 440, 442.

To form the tubular-shaped support 400, in some examples, the support 400 is folded about the lines of weakness 410, 414, 416, 418, 419, 420 and the sides 406, 408 of the support 400 are brought together and coupled. In the illustrated example of FIG. 4, to couple the sides 406, 408 of the support 400 together, a tongue 444 adjacent the second side 408 is received in the aperture 412 defined adjacent the first side 406 of the support 400. In some examples, once the tongue 444 is inserted through the aperture 412, the smaller panels 430, 434 are further coupled using, for example, adhesive, glue, tape, a staple(s), and/or any suitable mechanical and/or chemical fastener(s).

To outwardly bias the smaller panels 430, 432, 434, after the sides 430, 434 of the support 400 are coupled and/or the tongue 44 is received in the aperture 412, an elastic band is disposed about the support 400 and within the notches 436, 438, 440, 442. In this example, portions of the elastic band are disposed relatively parallel to the lines of weakness 414, 419 that separate the respective larger panels 422, 424, 426, 428 and portions of the elastic band extend between the lines of weakness 414, 419 and/or the interior of the support. As used herein, substantially parallel means between about 5-degrees of parallel and/or accounts for manufacturing tolerances. To enable the support 400 to be coupled to the opposing shroud panels 106, 108, adhesive and/or tape 446, 448 is positioned on outward facing surfaces of the second and third smaller panels 432, 434.

Figure 5:
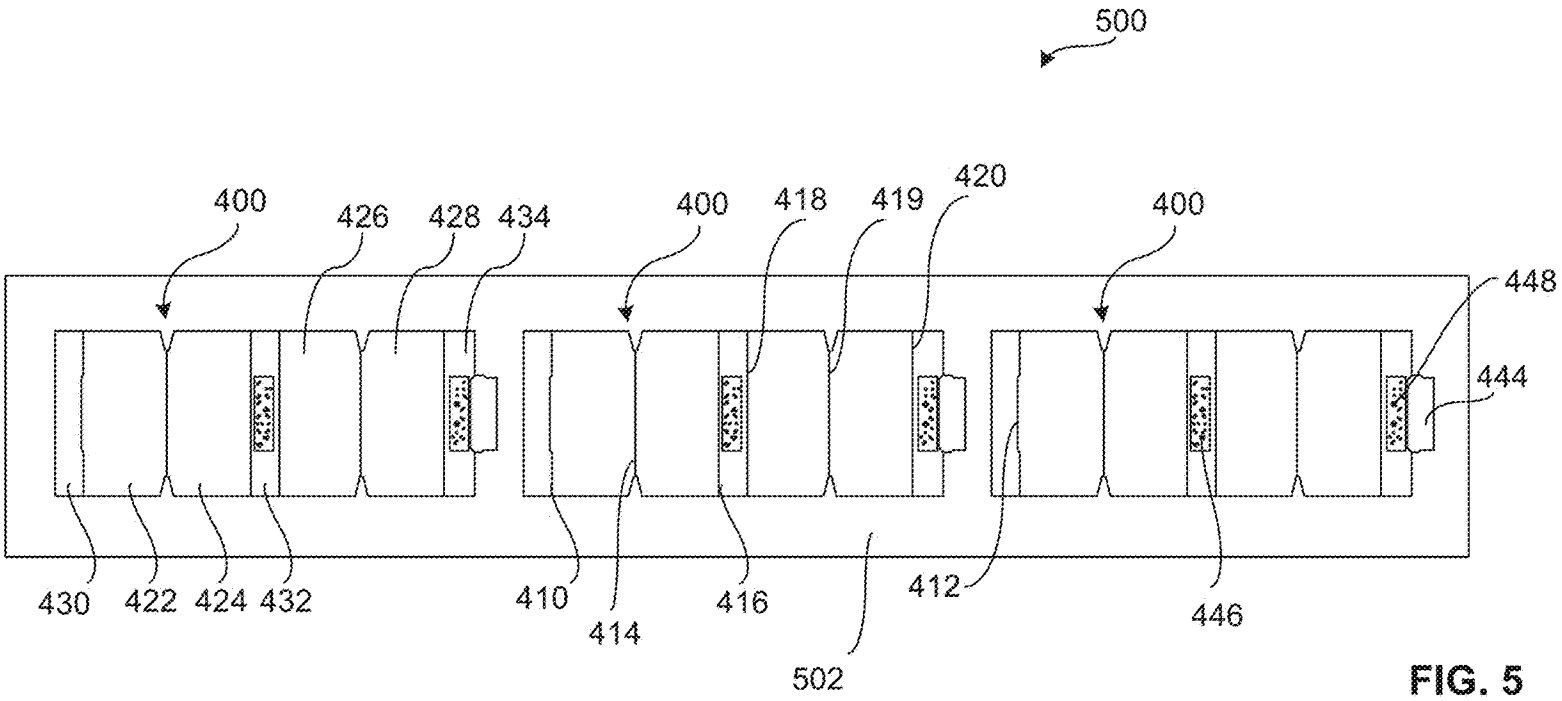
FIG. 5 illustrates a plan view of an example web including a plurality of example supports that can be used to implement the examples disclosed herein.

FIG. 5 illustrates an example web 500 including the supports 400 that can be used to implement the examples disclosed herein. In practice, in some examples, each of the supports 400 may be die cut from a waste matrix 502 surrounding the supports 400 prior to forming the tubular support.

Figure 6:
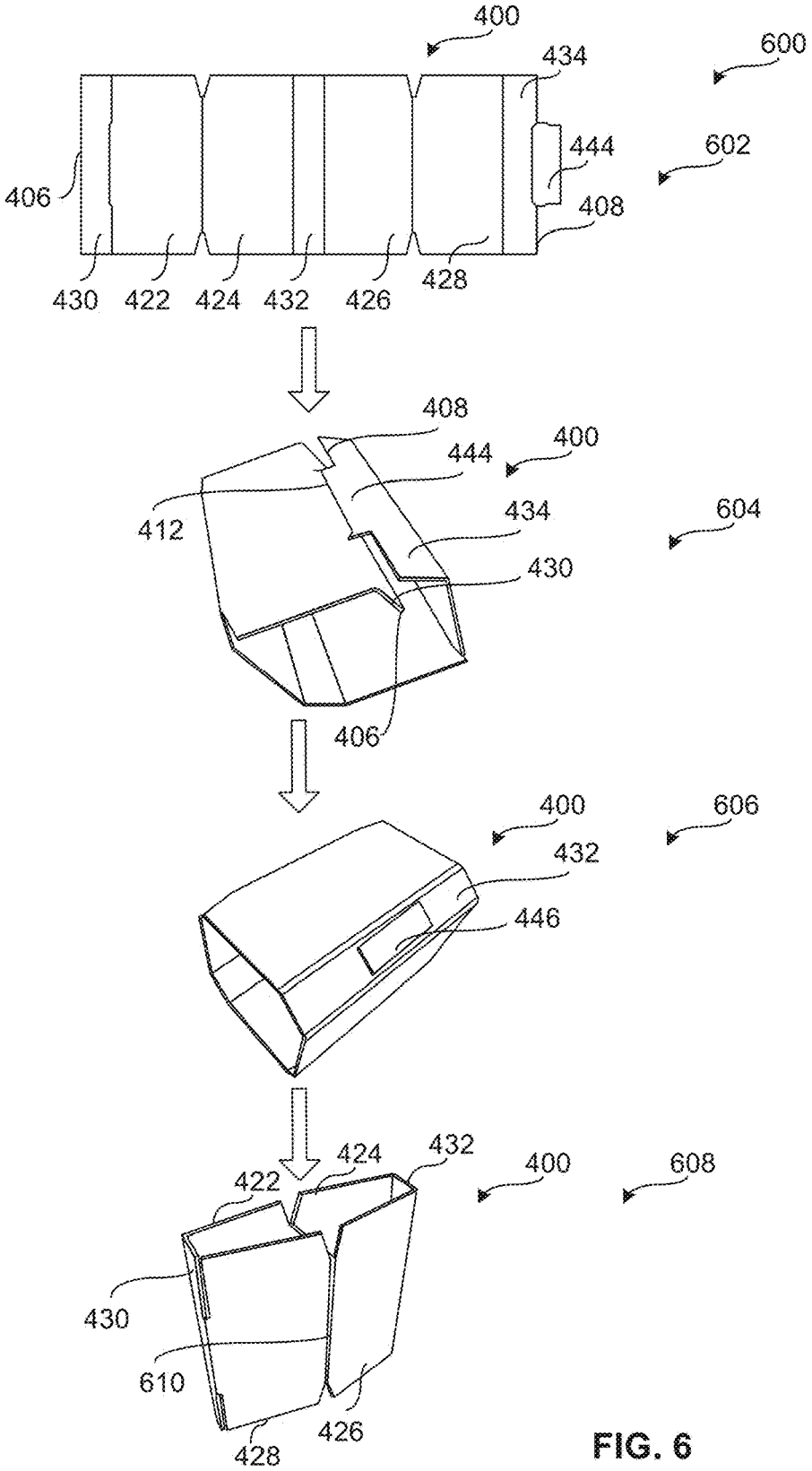
FIG. 6 illustrates an example flow diagram including processes of forming an example support that can used to implement the example self-erectable display of FIG. 1.

FIG. 6 is an example flow diagram 600 that illustrates example processes of assembling the example support 400. Reference number 602 illustrates the example support 400 in a flat or non-tubular state. At reference number 604, the support 400 is being folded about the lines of weakness 410, 414, 416, 418, 419, 420 and the sides 406, 408 of the support 400 are being brought together to position the tongue 444 within the aperture 412 to couple the sides 406, 408 together. At reference number 606, the fasteners 446, 448 (e.g., double sided tape) are coupled to the outwardly facing surfaces of the smaller support panels 432, 434. After the sides 430, 434 of the support 400 are coupled, to urge the larger panels 422, 424, 426, 428 toward one another and to outwardly bias the smaller panels 430, 432, 434 and as shown at reference number 608, an elastic band 610 is disposed about the support 400 and within the notches 436, 438, 440, 442. In this example, the elastic band 610 is disposed relatively parallel to the lines of weakness 414, 419.

Figure 7:
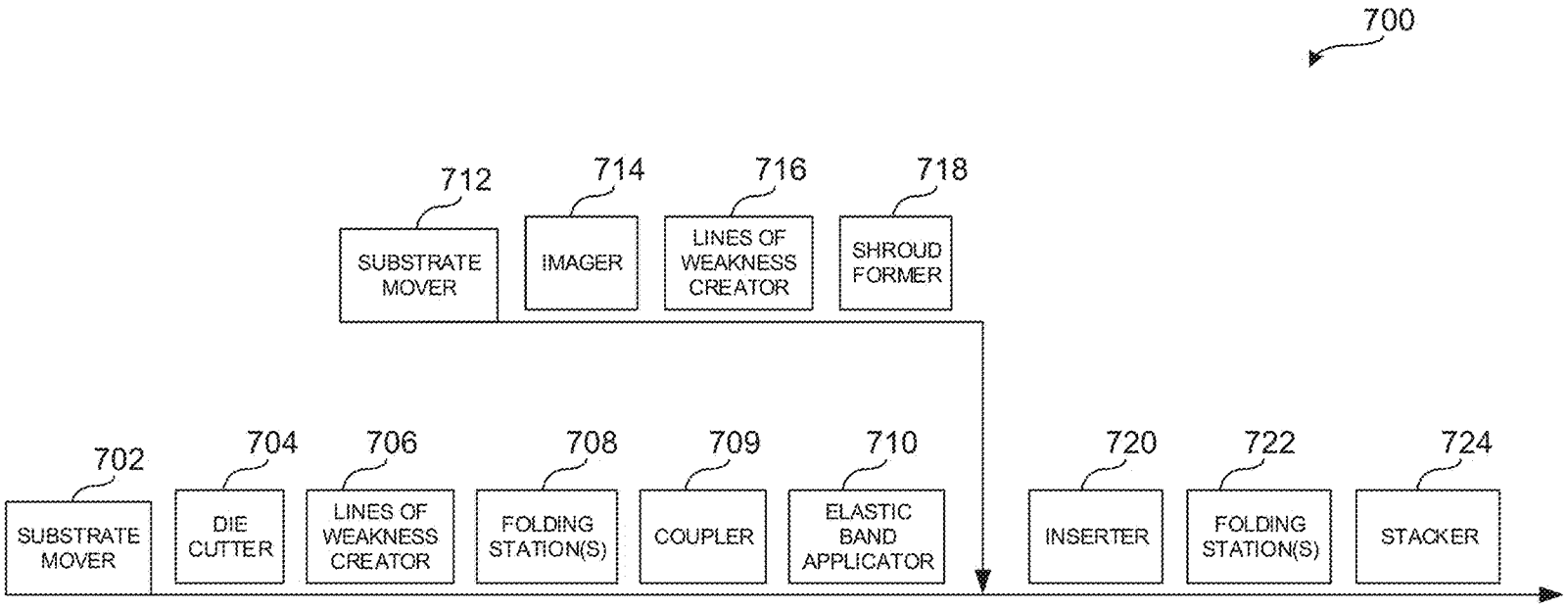
FIG. 7 illustrates an example apparatus that can be used to produce the example self-erectable displays disclosed herein.

FIG. 7 represents an example apparatus 700 that can be used to produce the example self-erectable displays disclosed herein. In some examples, the apparatus 700 performs an in-line process that includes processes to produce an example support in accordance with the teachings of this disclosure, processes to produce an example shroud in accordance with the teachings of this disclosure and processes to produce an example self-erectable display in accordance with the teachings of this disclosure. While the processes disclosed below are described in connection with automatic processes, any and/or all of the processes disclosed may instead be implemented manually.

In this example, the example apparatus 700 includes elements to produce the example support including, for example, a substrate mover 702, a die cutter 704, a lines of weakness creator 706, a folding station 708, a coupler 709 and an elastic band applicator 710. In this example, the example apparatus 700 also includes elements to produce the example shroud including, for example, a substrate mover 712, an imager 714, a lines of weakness creator 716 and a shroud former 718. In this example, the apparatus 700 also includes elements to produce the example self-erectable display including, for example, an inserter 720, a folding station 722 and a stacker 724.

To produce an example support in accordance with the teachings of this disclosure, in some examples, the substrate mover 702 feeds one or more pieces of substrate and/or a web of substrate into the apparatus 700. The die cutter 704 die cuts the substrate to form a support blank and a waste matrix, and the lines of weakness creator 706 forms one or more lines of weakness on first and/or second sides of the support blank using a die(s), a cutting tool(s), a scoring tool(s), a slotting tool(s), etc. The folding station 708 folds the support blank along one or more of the lines of weakness to form a tubular support. The coupler 709 couples the ends of the support together by, for example, inserting a tongue on one end of the support into an aperture adjacent another end of the support. In some examples, the coupler 709 applies a fastener such as, for example, an adhesive, glue and/or tape to one or more of the smaller support panels to enable the tubular support to be coupled within the tubular shroud. The elastic band applicator 710 positions an elastic band about the support within notches defined by the support. In some examples, the processes implemented by the folding station 708, the coupler 709 and/or the elastic band applicator 710 are performed manually.

To produce an example shroud in accordance with the teachings of this disclosure, in some examples, the substrate mover 712 feeds one or more pieces of substrate and/or a web of substrate into the apparatus 700. In some examples, the imager 714 images a first and/or a second side of the shroud blank. The images may include brand-related images and/or text, advertising-related images and/or text, point-of-purchase-related images and/or text, instructional images and/or text, and/or any other desired indicia. The lines of weakness creator 716 forms one or more lines of weakness on first and/or second sides of the shroud blank using a die(s), a cutting tool(s), a scoring tool(s), a slotting tool(s), etc. In some examples, the shroud former 718 forms a tubular-shaped shroud by folding the shroud about a central line of weakness and coupling inwardly facing flaps. In some examples, the processes implemented by the shroud former 718 is performed manually.

To produce an example self-erectable display in accordance with the teachings of this disclosure, in some examples, the inserter 720 inserts and couples one or more example tubular supports within the example shroud. The folding station 722 flattens and/or folds the self-erectable display about longitudinal axes of the shroud and/or folds the self-erectable display about transverse axes of the shroud for storage and/or shipping. The stacker 724 stacks self-erectable displays for storage and/or shipping, etc. In some examples, the processes implemented by the inserter 720, the folding station 722 and/or the stacker 724 are performed manually.

While the stations and/or portions including the example substrate mover 702, the example die cutter 704, the example lines of weakness creator 706, the example folding station 708, the example coupler 709, the example elastic band applicator 710, the example substrate mover 712, the example imager 714, the example lines of weakness creator 716, the example shroud former 718, the example inserter 720, the example folding station 722, the example stacker 724 of the apparatus 700 are depicted in a particular order, the stations and/or portions including the example substrate mover 702, the example die cutter 704, the example lines of weakness creator 706, the example folding station 708, the example coupler 709, the example elastic band applicator 710, the example substrate mover 712, the example imager 714, the example lines of weakness creator 716, the example shroud former 718, the example inserter 720, the example folding station 722, the example stacker 724 may be implemented in any other way. For example, the order of the stations and/or portions including the example substrate mover 702, the example die cutter 704, the example lines of weakness creator 706, the example folding station 708, the example coupler 709, the example elastic band applicator 710, the example substrate mover 712, the example imager 714, the example lines of weakness creator 716, the example shroud former 718, the example inserter 720, the example folding station 722, the example stacker 724 may be changed, and/or some of the stations and/or portions including the example substrate mover 702, the example die cutter 704, the example lines of weakness creator 706, the example folding station 708, the example coupler 709, the example elastic band applicator 710, the example substrate mover 712, the example imager 714, the example lines of weakness creator 716, the example shroud former 718, the example inserter 720, the example folding station 722, the example stacker 724 may be changed, eliminated, or combined. For example, while the apparatus 700 is depicted as having a die cutter being separate from a lines of weakness creator, in some examples, the die cutter and the lines of weakness creator may be combined.

Figure 8:
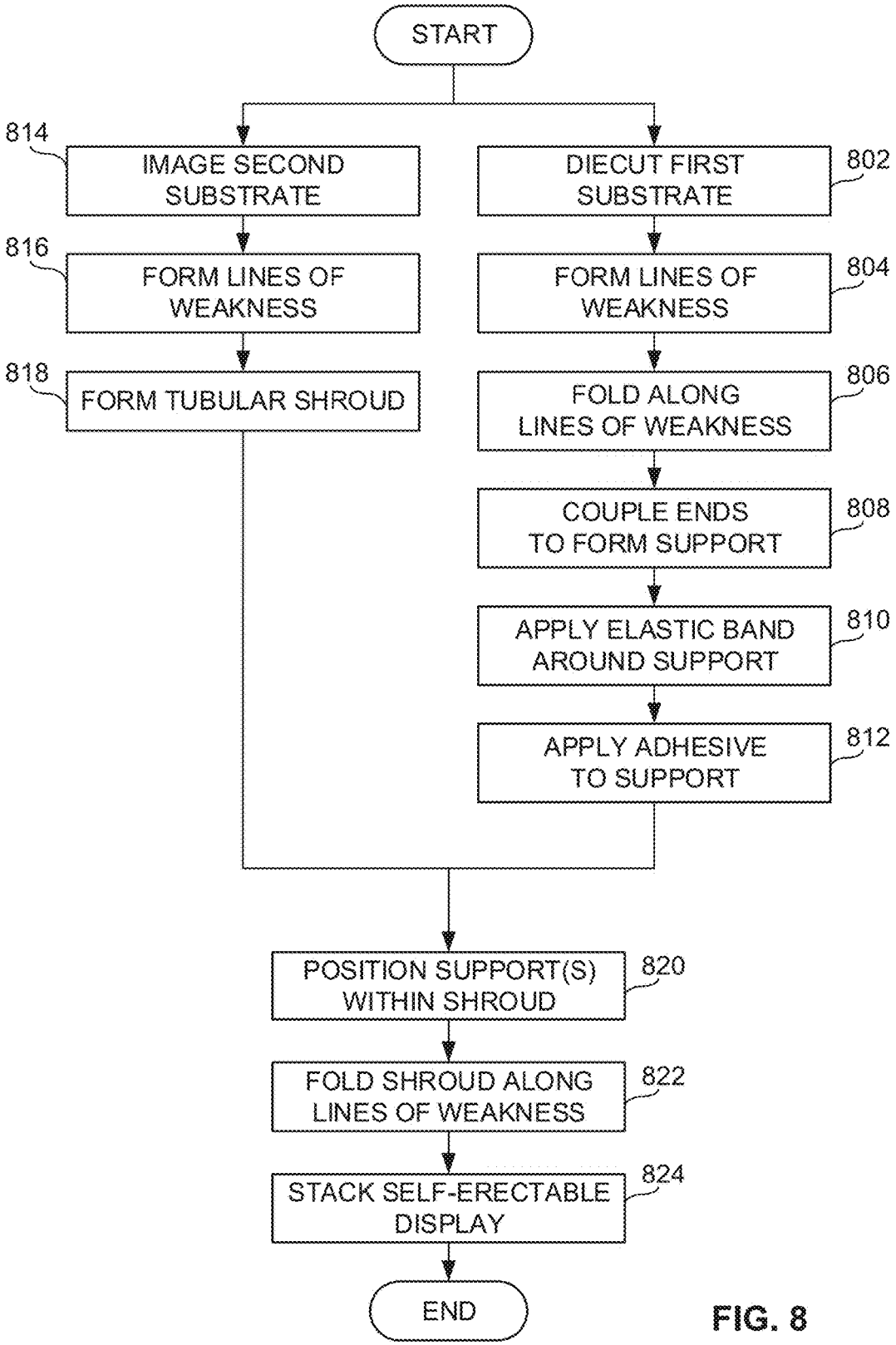
FIG. 8 illustrates a flowchart representative of machine readable instructions that may be executed to implement the apparatus of FIG. 7.

A flowchart representative of example machine readable instructions for implementing the apparatus 700 of FIG. 7 is shown in FIG. 8. In this example, the machine readable instructions comprise a program for execution by a processor such as the processor 912 shown in the example processor platform 900 discussed below in connection with FIG. 9. The program may be embodied in software stored on a tangible computer readable storage medium such as a CD-ROM, a floppy disk, a hard drive, a digital versatile disk (DVD), a Blu-ray disk, or a memory associated with the processor 912, but the entire program and/or parts thereof could alternatively be executed by a device other than the processor 912 and/or embodied in firmware or dedicated hardware. Further, although the example program is described with reference to the flowchart illustrated in FIG. 8, many other methods of implementing the example apparatus 700 may alternatively be used. For example, the order of execution of the blocks may be changed, and/or some of the blocks described may be changed, eliminated, or combined.

As mentioned above, the example processes of FIG. 8 may be implemented using coded instructions (e.g., computer and/or machine readable instructions) stored on a tangible computer readable storage medium such as a hard disk drive, a flash memory, a read-only memory (ROM), a compact disk (CD), a digital versatile disk (DVD), a cache, a random-access memory (RAM) and/or any other storage device or storage disk in which information is stored for any duration (e.g., for extended time periods, permanently, for brief instances, for temporarily buffering, and/or for caching of the information). As used herein, the term tangible computer readable storage medium is expressly defined to include any type of computer readable storage device and/or storage disk and to exclude propagating signals and transmission media. As used herein, "tangible computer readable storage medium" and "tangible machine readable storage medium" are used interchangeably. Additionally or alternatively, the example processes of FIG. 8 may be implemented using coded instructions (e.g., computer and/or machine readable instructions) stored on a non-transitory computer and/or machine readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable storage device and/or storage disk and to exclude propagating signals and transmission media. As used herein, when the phrase "at least" is used as the transition term in a preamble of a claim, it is open-ended in the same manner as the term "comprising" is open ended.

The process of FIG. 8 directed toward producing an example support includes die cutting a first substrate (e.g., the support 400) (block 802) using, for example, the die cutter 704 that die cuts one or more pieces of substrate and/or a web of substrate to form a support blank and a waste matrix. Lines of weakness are formed on the support blank (block 804) by, for example, the lines of weakness creator 706 forming one or more lines of weakness on first and/or second sides of the support blank using a die(s), a cutting tool(s), a scoring tool(s), a slotting tool(s), etc. The support blank is folded about the lines of weakness (block 806) by, for example, the folding station 708 that folds the support blank along the lines of weakness to form a tubular support. The ends of the support are coupled to form the support (block 808) using, for example, the coupler 709 that couples the ends of the support together by inserting a tongue adjacent one end of the support into an aperture adjacent another end of the support. An elastic band is applied around the support (block 810) using, for example, the elastic band applicator 710 that positions the elastic band about the support such that the elastic band extends between top and bottom edges of the support and across an aperture defined by the tubular support. Fastener(s) such as, for example, an adhesive (e.g., double sided tape) is applied to an exterior surface(s) of the support (block 812) using, for example, the coupler 708 that applies adhesive to one or more of the smaller support panels.

The process of FIG. 8 directed toward producing an example shroud includes imaging a second substrate (e.g., the shroud 300) (block 814) using, for example, the imager 714 that images a first and/or second side of the shroud with, for example, brand-related images and/or text, advertising-related images and/or text, point-of-purchase-related images and/or text, instructional images and/or other text, indicia and/or images. Lines of weakness are formed on the shroud blank (block 816) using, for example, the lines of weakness creator 716 that forms one or more lines of weakness on first and/or second sides of the shroud blank using a die(s), a cutting tool(s), a scoring tool(s), a slotting tool(s), etc. The tubular shroud is formed (block 818) using, for example, the shroud former 718 that folds the shroud about a central line of weakness and couples inwardly facing flaps using, for example, adhesive, glue and/or a staple(s).

The process of FIG. 8 directed toward producing an example self-erectable display in accordance with the teachings of this disclosure also includes inserting a support(s) within the shroud (block 820) using, for example, the inserter 720 that inserts and couples the support(s) within the shroud such that outwardly biased support panels expand the opposing shroud panels to enable the shroud to have an oblong cross-section when erected. The self-erectable display is folded along lines of weakness (block 822) using, for example, the folding station 722 that flattens and/or folds the self-erectable display about longitudinal axes of the shroud and/or transverse axes of the shroud for storage and/or shipping. The folded self-erectable display is stacked (block 824) using, for example, the stacker 724 that stacks the self-erectable displays for storage and/or shipping, etc.

Figure 9:
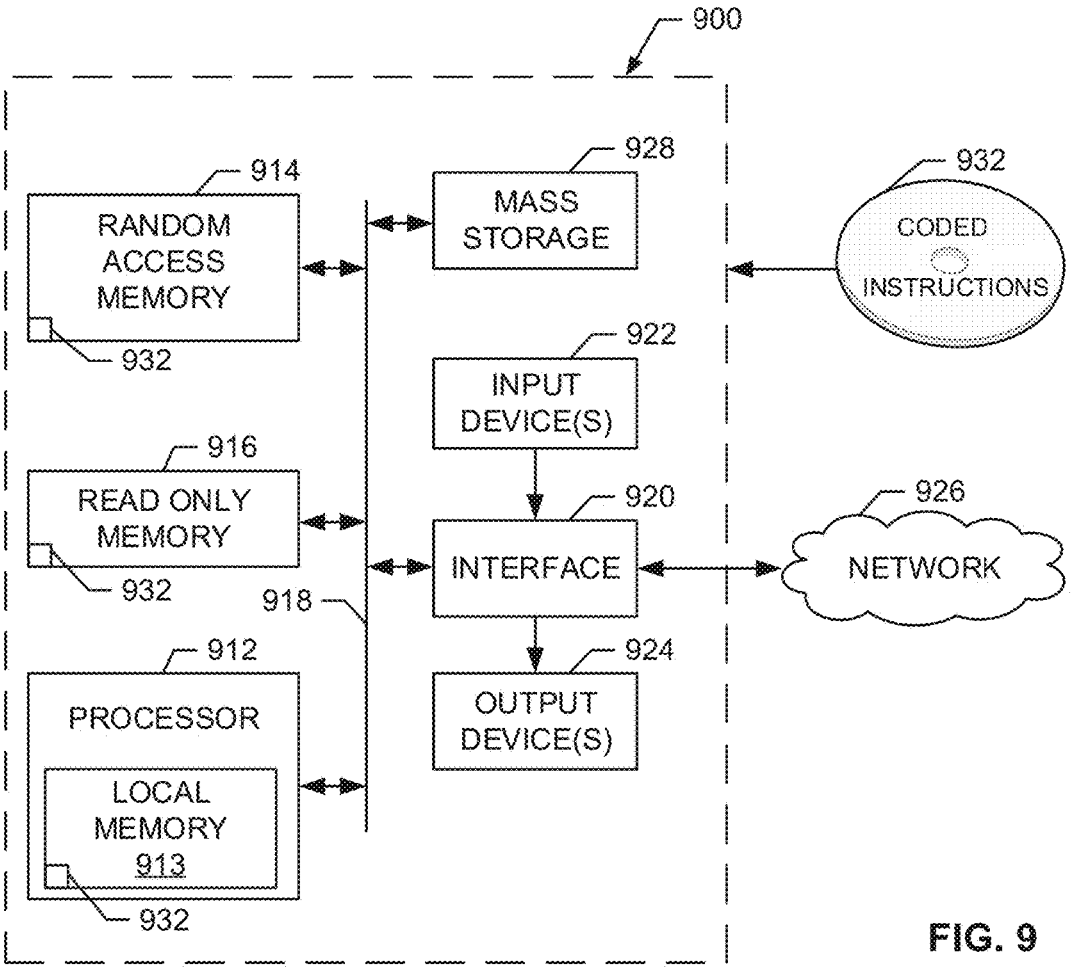
FIG. 9 illustrates a processor platform to execute the instructions of FIG. 8 to implement the apparatus of FIG. 7.

FIG. 9 is a block diagram of an example processor platform 900 capable of executing the instructions of FIG. 8 to implement the apparatus 700 of FIG. 7. The processor platform 800 can be, for example, a server, a personal computer, a mobile device (e.g., a tablet such as an iPad™), an Internet appliance, a DVD player, a CD player, a digital video recorder, a Blu-ray player, or any other type of computing device.

The processor platform 900 of the illustrated example includes a processor 912. The processor 912 of the illustrated example is hardware. For example, the processor 912 can be implemented by one or more integrated circuits, logic circuits, microprocessors or controllers from any desired family or manufacturer.

The processor 912 of the illustrated example includes a local memory 913 (e.g., a cache). The processor 912 of the illustrated example is in communication with a main memory including a volatile memory 914 and a non-volatile memory 916 via a bus 918. The volatile memory 914 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 916 may be implemented by flash memory and/or any other desired type of memory device. Access to the main memory 914, 916 is controlled by a memory controller.

The processor platform 900 of the illustrated example also includes an interface circuit 920. The interface circuit 920 may be implemented by any type of interface standard, such as an Ethernet interface, a universal serial bus (USB), and/or a PCI express interface.

In the illustrated example, one or more input devices 922 are connected to the interface circuit 920. The input device(s) 922 permit(s) a user to enter data and commands into the processor 912. The input device(s) can be implemented by, for example, an audio sensor, a microphone, a camera (still or video), a keyboard, a button, a mouse, a touchscreen, a track-pad, a trackball, isopoint and/or a voice recognition system.

One or more output devices 924 are also connected to the interface circuit 920 of the illustrated example. The output devices 924 can be implemented, for example, by display devices (e.g., a light emitting diode (LED), an organic light emitting diode (OLED), a liquid crystal display, a cathode ray tube display (CRT), a touchscreen, a tactile output device, a light emitting diode (LED), a printer and/or speakers). The interface circuit 920 of the illustrated example, thus, typically includes a graphics driver card, a graphics driver chip or a graphics driver processor.

The interface circuit 920 of the illustrated example also includes a communication device such as a transmitter, a receiver, a transceiver, a modem and/or network interface card to facilitate exchange of data with external machines (e.g., computing devices of any kind) via a network 926 (e.g., an Ethernet connection, a digital subscriber line (DSL), a telephone line, coaxial cable, a cellular telephone system, etc.).

The processor platform 900 of the illustrated example also includes one or more mass storage devices 928 for storing software and/or data. Examples of such mass storage devices 928 include floppy disk drives, hard drive disks, compact disk drives, Blu-ray disk drives, RAID systems, and digital versatile disk (DVD) drives.

The coded instructions 932 of FIG. 8 may be stored in the mass storage device 928, in the volatile memory 914, in the non-volatile memory 916, and/or on a removable tangible computer readable storage medium such as a CD or DVD.

As set forth herein, an example apparatus includes a shroud having a first shroud panel opposite a second shroud panel; a support coupled within the shroud, the support including a top edge, a bottom edge, and first and second sides edges, the first side edge coupled adjacent the second side edge; and an elastic band to be coupled to the support and outwardly bias the shroud to enable the shroud to have the oblong cross-section when erected, a portion of the elastic band being substantially parallel to a longitudinal axis of the support. In some examples, the top and bottom edges define notches into which the elastic band is disposed. In some examples, the support further includes a tongue adjacent the first edge and an aperture adjacent the second edge, the aperture to receive the tongue to couple the first and second side edges. In some examples, the support is folded to define first and second support panels, the first support panel to be coupled to the first shroud panel and the second support panel to be coupled to the second shroud panel.

In some examples, the support further includes a notch defined by the top edge or the bottom edge into which the elastic band is to be disposed, the notch positioned between the first support panel and the second support panel. In some examples, the shroud further includes a first shroud line of weakness and a second shroud line of weakness, the first shroud line of weakness separating the first shroud panel and the second shroud panel at a first end of the shroud, the second shroud line of weakness separating the first shroud panel and the second shroud panel at a second end of the shroud. In some examples, the shroud is foldable about the first and second shroud lines of weakness by urging the first shroud panel toward the second shroud panel against a biasing force of the elastic band.

In some examples, the shroud further includes inwardly facing flaps that are coupled to enable the shroud to have the oblong cross-section when erected. In some examples, the first shroud panel includes a first transverse line of weakness and the second shroud panel includes a second transverse line of weakness, the first and second transverse lines of weakness being substantially within a plane of the shroud to enable the first and second lines of weakness to be immediately adjacent one another when the first and second shroud panels are being folded about the first and second transverse lines of weakness. In some examples, the shroud is foldable about the first and second transverse lines of weakness. In some examples, the apparatus is a self-erecting display.

An example apparatus includes a support to be coupled within a self-erecting display, the support including a top edge, a bottom edge, and first and second sides edges, the first side edge coupled adjacent the second side edge; and an elastic band to be coupled to the support and outwardly bias the display when the support is coupled therein, a portion of the elastic band being substantially parallel a longitudinal axis of the support. In some examples, the top and bottom edges define notches into which the elastic band is disposed. In some examples, the support further includes a tongue adjacent the first edge and an aperture adjacent the second edge, the aperture to receive the tongue to couple the first and second side edges. In some examples, the support is folded to define first and second support panels, the first support panel to be coupled to the first shroud panel and the second support panel to be coupled to the second shroud panel. In some examples, the support further includes a notch defined by the top edge or the bottom edge into which the elastic band is to be disposed, the notch positioned between the first support panel and the second support panel.

An example apparatus includes a shroud including a first shroud panel, a second shroud panel coupled to the first shroud panel, and an interior formed between the first shroud panel and the second shroud panel; a support disposed in the interior of the shroud, the support including a top edge, a bottom edge, and first and second sides edges, the first side edge coupled adjacent the second side edge, and one of the first side edge or the second side edge coupled to one of the first shroud panel or the second shroud panel; and a biasing member coupled to the support such that at least a portion of the biasing member is substantially parallel to a longitudinal axis of the support, the biasing member to cause a portion of the first shroud panel to separate from a portion of the second shroud panel.

In some examples, the interior has an oblong cross-section. In some examples, the biasing member surrounds the support. In some examples, the biasing member is an elastic band. In some examples, the support is a first support, further including a second support disposed in the interior of the shroud spaced from the first support. In some examples, the top edge is a first top edge and the bottom edge is a first bottom edge, the second support includes a second top edge, a second bottom edge, and third and fourth sides edges, the third side edge coupled adjacent the fourth side edge, and one of the third side edge or the fourth side edge coupled to one of the first shroud panel or the second shroud panel.

The examples self-erectable displays disclosed herein may be deployed from a storage state to an erected or deployed state with little effort. For example, a user such as, for example, a shop clerk, can remove a folded display from an outer packaging or container and unfold the display along the lines of weakness disclosed above. The force imparted by the biasing member(s) on the internal supports, automatically forces the outer shroud panels to expand away from one of other as disclosed above. In other words, as the display is unfolded, the display simply pops open by itself. The deployment of the display is then complete and the display is ready for placement in a desired location and/or coupling to an optional base should additional stability be desired.

An example apparatus, a shroud including a first shroud panel opposite a second shroud panel, the first shroud panel and the second shroud panel coupled at a first end and a second end of the shroud; a support coupled within the shroud and centrally disposed between the first shroud panel and the second shroud panel and spaced from the first and second ends of the shroud, the support including a top edge, a bottom edge, and first and second sides edges, the first side edge coupled adjacent the second side edge; an elastic band is to be coupled to the support and to outwardly bias the shroud to enable the shroud to have an oblong cross-section when erected; and when the elastic band is coupled to the support, the elastic band surrounds the support engaging the top edge and the bottom edge to position a portion of the elastic band substantially parallel to a longitudinal axis of the support.

In some examples, the top and bottom edges define notches into which the elastic band is to be disposed. In some examples, the support further including a tongue adjacent the first edge and an aperture adjacent the second edge, the aperture to receive the tongue to couple the first and second side edges. In some examples, the support is folded to define first and second support panels, the first support panel to be coupled to the first shroud panel and the second support panel to be coupled to the second shroud panel. In some examples, the apparatus includes a notch defined by the top edge or the bottom edge into which the elastic band is to be disposed, the notch positioned between the first support panel and the second support panel. In some examples, the shroud further includes a first shroud line of weakness and a second shroud line of weakness, the first shroud line of weakness separating the first shroud panel and the second shroud panel at the first end of the shroud, the second shroud line of weakness separating the first shroud panel and the second shroud panel at the second end of the shroud.

In some examples, the shroud is foldable about the first and second shroud lines of weakness by urging the first shroud panel toward the second shroud panel against a biasing force of the elastic band. In some examples, the shroud further includes inwardly facing flaps that are coupled to enable the shroud to have the oblong cross-section when erected. In some examples, the first shroud panel includes a first transverse line of weakness and the second shroud panel includes a second transverse line of weakness, the first and second transverse lines of weakness being substantially within a plane of the shroud to enable the first and second transverse lines of weakness to be immediately adjacent one another when the first and second shroud panels are being folded about the first and second transverse lines of weakness. In some examples, the shroud is foldable about the first and second transverse lines of weakness. In some examples, the apparatus is a self-erecting display.

An includes apparatus includes a shroud including a first shroud panel, a second shroud panel coupled to the first shroud panel, and an interior formed between the first shroud panel and the second shroud panel; a support disposed in the interior of the shroud, the support including a top edge, a bottom edge, and first and second sides edges, the first side edge coupled adjacent the second side edge, and one of the first side edge or the second side edge coupled to one of the first shroud panel or the second shroud panel; and a biasing member coupled to the support such that the biasing member surrounds the support engaging the top edge and the bottom edge and opposing first and second support panels to position a portion of the biasing member substantially parallel to a longitudinal axis of the support, the biasing member to cause a portion of the first shroud panel to separate from a portion of the second shroud panel.

In some examples, the interior has an oblong cross-section. In some examples, the biasing member is an elastic band. In some examples, the support is a first support, further including a second support disposed in the interior of the shroud spaced from the first support. In some examples, the top edge is a first top edge and the bottom edge is a first bottom edge, the second support includes a second top edge, a second bottom edge, and third and fourth sides edges, the third side edge coupled adjacent the fourth side edge, and one of the third side edge or the fourth side edge coupled to one of the first shroud panel or the second shroud panel. In some examples, the support includes a first support panel and a second support panel, the first support panel coupled to the first shroud panel, the second support panel coupled to the second shroud panel, the first support panel substantially parallel to the second support panel.

An example apparatus includes a shroud including a first shroud panel opposite a second shroud panel; a support coupled within the shroud, the support including a first support panel and a second support panel, the first support panel coupled to the first shroud panel, the second support panel coupled to the second shroud panel, the first support panel substantially parallel to the second support panel when the support is in an expanded state, the support including a top edge, a bottom edge, and first and second sides edges, the first side edge coupled adjacent the second side edge; and an elastic band to be coupled to and to surround the support and to outwardly bias the shroud to enable the shroud to have an oblong cross-section when erected, a portion of the elastic band being substantially parallel to a longitudinal axis of the support.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. An apparatus comprising:

a shroud defining a first aperture, the shroud including a first shroud panel and a second shroud panel;

a support disposed within the first aperture, the support including a first panel, a second panel, a third panel, a fourth panel, a fifth panel, and a sixth panel, the first panel coupled to the sixth panel, the second panel disposed between the first and third panels, the fourth panel disposed between the third and fifth panels, the sixth panel disposed between the first and fifth panels, the first panel coupled to the first shroud panel and the fourth panel coupled to the second shroud panel, the first panel including a tongue to be received in a second aperture of the support to couple the first panel and the sixth panel, wherein the second aperture is defined between the sixth panel and a seventh panel; and an elastic band to urge the first panel away from the fourth panel and to urge the shroud toward an expanded position.

2. The apparatus of claim 1, wherein the sixth panel is coupled to the first panel via a seventh panel.

3. The apparatus of claim 1, further including first adhesive and second adhesive, the first adhesive being disposed on the first panel to couple the first panel to the first shroud panel, the second adhesive being disposed on the fourth panel to couple the fourth panel to the second shroud panel.

4. The apparatus of claim 1, further including first notches and second notches, the first notches defined between the second and third panels, the second notches defined between the fifth and sixth panels.

5. The apparatus of claim 4, wherein the first and second notches receive the elastic band.

6. The apparatus of claim 1, wherein the second and sixth panels are symmetric about a transverse axis of the support that extends through the fourth panel, the third and fifth panels are symmetric about the transverse axis.

7. The apparatus of claim 6, wherein the second, third, fifth, and sixth panels are substantially similarly sized.

8. The apparatus of claim 7, wherein the first and fourth panels are substantially similarly sized.

9. The apparatus of claim 1, wherein the support has a polygonal cross-section when the shroud is in the expanded position.

10. The apparatus of claim 1, wherein the support is a first support, further including a second support disposed within the shroud, the second support structured to urge the shroud toward the expanded position.

11. The apparatus of claim 10, wherein the second support includes a seventh panel, an eighth panel, a ninth panel, a tenth panel, an eleventh panel, and a twelfth panel, the seventh panel coupled to the twelfth panel, the eighth panel disposed between the seventh and ninth panels, the ninth panel disposed between the eighth panel and the tenth panel, the tenth panel disposed between the ninth panel and the eleventh panel, the eleventh panel disposed between the tenth panel and the twelfth panel.

12. The apparatus of claim 11, wherein the twelfth panel is coupled to the seventh panel via a thirteenth panel.

13. The apparatus of claim 1, wherein the elastic band is coupled between the second and third panels and the fifth and sixth panels and extends across the support.

14. An apparatus, comprising:

a shroud including a first shroud panel opposite a second shroud panel;

a support including a first panel, a second panel, a third panel, a fourth panel, a fifth panel, a sixth panel, and a seventh panel, the first panel centrally coupled to the first shroud panel, the second panel centrally coupled to the second shroud panel, the third panel disposed between the first panel and the second panel, the fourth panel disposed between the third panel and the second panel, the second panel disposed between the fourth panel and the fifth panel, the fifth panel disposed between the second panel and the sixth panel, the first panel coupled to the sixth panel via the seventh panel, the first panel including a tongue that is receivable in an aperture defined between the sixth and seventh panels to couple the first panel to the sixth panel, the support having first notches and second notches, the first notches disposed on a first side of the coupling of the first panel and the first shroud panel, the second notches disposed on a second side of the coupling of the first panel and the first shroud panel, the first notches disposed between the coupling of the first panel and the first shroud panel and the coupling of the second panel and the second shroud panel, the second notches disposed between the coupling of the first panel and the first shroud panel and the coupling of the second panel and the second shroud panel, the first notches disposed between the third and fourth panels, and the second notches are disposed between the fifth and sixth panels; and an elastic band to be coupled to the support and outwardly bias the shroud to enable the shroud to have an oblong cross-section when erected.

15. An apparatus, comprising:

a shroud defining an aperture, the shroud including a first shroud panel and a second shroud panel;

a support centrally disposed within the aperture, the support including a first panel, a second panel, a third panel, and a fourth panel, the first panel coupled to the second panel at a first coupling, the first coupling including a first line of weakness, the second panel coupled to the third panel at a second coupling, the second coupling centrally engaging the first shroud panel, and the second coupling including a fifth panel, the fifth panel disposed between the second panel and the third panel to couple the second and third panels, the third panel coupled to the fourth panel at a third coupling, the third coupling including a second line of weakness, and the fourth panel coupled to the first panel at a fourth coupling, the fourth coupling centrally engaging the second shroud panel, and the fourth coupling including a sixth panel, the sixth panel disposed between the first panel and the fourth panel to couple the first and fourth panels, and the sixth panel coupled to the first panel via a seventh panel; and an elastic band to urge the second coupling away from the fourth coupling and to urge the shroud toward an expanded position.

16. The apparatus of claim 15, wherein the fourth coupling includes a fifth panel, the fifth panel disposed between the first panel and the fourth panel to couple the first and fourth panels.

17. The apparatus of claim 16, wherein the fifth panel is coupled to the first panel via a sixth panel.

18. The apparatus of claim 17, wherein the fifth panel includes a tongue that is received in an aperture defined between the fourth panel and the sixth panel to couple the first panel and the fourth panel.

* * * * *